US006095891A

United States Patent [19]

Hoeting et al.

[11] Patent Number: 6,095,891

[45] Date of Patent: Aug. 1, 2000

[54] REMOTE CONTROL TOY VEHICLE WITH IMPROVED STABILITY

[75] Inventors: Michael G. Hoeting; Sean T. Mullaney, both of Cincinnati, Ohio

[73] Assignee: Bang Zoom design, Ltd., Cincinnati, Ohio

[21] Appl. No.: 09/195,767

[22] Filed: Nov. 18, 1998

[51] Int. Cl.[7] ..... A63H 17/16

[52] U.S. Cl. ..... 446/440; 446/431

[58] Field of Search ..... 446/3, 273, 431, 446/436, 437, 440, 454, 458, 460, 462

[56] References Cited

U.S. PATENT DOCUMENTS

| | | | |
|---|---|---|---|
| 4,201,011 | 5/1980 | Cook . | |
| 4,342,175 | 8/1982 | Cernansky et al. | 446/440 |
| 4,383,388 | 5/1983 | Suimon | 446/440 |
| 4,387,532 | 6/1983 | Suimon | 446/440 |
| 4,712,806 | 12/1987 | Patrin . | |
| 4,740,001 | 4/1988 | Torleumke . | |
| 4,767,376 | 8/1988 | Hanzawa | 446/457 |
| 4,902,271 | 2/1990 | Yoneda | 446/440 |
| 4,966,569 | 10/1990 | Asano | 446/440 |
| 5,368,516 | 11/1994 | Hoeting et al. | 446/440 X |
| 5,709,583 | 1/1998 | Suto et al. | 446/440 |
| 5,820,439 | 10/1998 | Hair, III | 446/440 X |

*Primary Examiner*—Sam Rimell
*Attorney, Agent, or Firm*—Wood, Herron & Evans, L.L.P.

[57] ABSTRACT

A remote control toy motorcycle includes a steering link and a four-bar linkage to connect a front castering wheel to a chassis, to utilize the castering wheel principle and the counter steering principle in a manner which enhances the stability of the motorcycle, thereby enabling it to be operated on rugged terrain. A steering drive responds to radio signals to cause the link to pivot the four-bar linkage to initiate and maintain a turn. The four-bar linkage has spaced members located on opposite sides of the longitudinal axis, with rearward ends pivotally connected to the chassis at locations further from the longitudinal axis than forward ends which pivotally connect to the front wheel fork coupler. The structure enables pivotal movement of the front wheel about a castering arc which is projected in front of the four-bar linkage. The toy vehicle further includes a weighted flywheel assembly incorporated within the rear wheel, to further enhance stability. A propulsion drive drives the rear wheel and the flywheel, with the gyroscopic flywheel rotating substantially faster than the rear wheel during operation.

23 Claims, 9 Drawing Sheets

REMOTE CONTROL TOY VEHICLE WITH IMPROVED STABILITY

FIELD OF THE INVENTION

The present invention relates to a remote control toy vehicle, and more particularly, a remote control toy motorcycle with a front wheel linkage and a rear wheel drive mechanism which makes the motorcycle particularly suitable for rugged terrain.

BACKGROUND

Remote control vehicles, and particularly remote control motorcycles are well known. Typically, a remote control motorcycle includes a chassis supported along a longitudinal axis by front and rear wheels, and the front wheel is a castering wheel having a fixed castering axis. One aspect of this invention relates to steering remote control motorcycles of this type.

U.S. Pat. No. 4,342,175 entitled "Radio Controlled Motorcycle," issued to Cernansky et al., describes a toy motorcycle which uses a shifting center of gravity to cause the motorcycle to lean to the left or to the right. The front wheel then "casters" or turns in the direction in which the motorcycle is leaning, thereby to turn in that direction. Applicants own U.S. Pat. No. 5,368,516 entitled "Radio-Controlled Two-Wheeled Toy Motorcycle" which describes a remote control motorcycle which uses a somewhat similar steering mechanism as the Cernansky design. However, in applicant's U.S. Pat. No. 5,368,516, the structure used for affecting the weight shift to initiate the turn differs somewhat to allow a more responsive turn.

Thus, these patents disclose a method of steering which involves a weight swing to the right or the left, such as by moving the batteries and the motor, etc., to displace the center of gravity of the motorcycle. The displacement of the center of gravity causes the motorcycle to turn in the direction of the displacement. When the displaced weight returns again to the centerline, i.e., along the longitudinal axis of the motorcycle, the force of the front wheel upon the castering axis causes the forward wheel to "castor" back to an in-line position, i.e., in-line with the longitudinal axis of the motorcycle.

A primary drawback with "gravity shift" steering mechanisms of this type is that they generally require a relatively large turning radius to turn the forward wheel about the castering axis. Also, motorcycles which use this steering mechanism must, by necessity, allow the forward or front wheel to castor in either direction in response to weight shifts of the rest of the motorcycle. That is, the front wheel must always be able to freely rotate in either direction in order to initiate a turn, but there is no control over this rotation of the castering wheel. For instance, if the front wheel of the vehicle were to encounter a bump along its path or uneven terrain, the castering wheel would respond by rotating the front wheel in the direction of least resistance.

More recent remote control motorcycles use a principle referred to as "counter-steering" to affect turning of the vehicle. For instance, U.S. Pat. No. 5,709,583 assigned to Tyco Industries, Inc. discloses a remote control motorcycle which using the counter-steering principle for turning. More specifically, this patent discloses a motorcycle which uses a servo operated spring force to turn the front wheel about its steering axis toward either the right or the left. Furthermore, if the applied spring force initially turns the front wheel to the left, the bike will then lean, or fall, to the right, in the opposite direction. This lean initiates a right turn because the weight of the bike leaning to the right initially forces the front wheel to straighten, i.e., rotate into the turn, as the gravity force of the motorcycle overcomes the applied spring force. The front wheel continues to rotate until it is turned to the right, thereby establishing a right turn. The spring force remains applied to the front wheel throughout the turn, and removal of the spring force causes the motorcycle to resume a straight path, with the front wheel in alignment with the longitudinal axis of the motorcycle.

U.S. Pat. No. 5,820,439, assigned to Shoot the Moon Products, Inc., describes another motorcycle which also uses the counter-steering principle. Instead of a servo/spring system, the motorcycle of the '439 patent uses a motor and a clutch to exert the counter-steering force. This motorcycle also includes a gyroscopic flywheel mounted between the two wheels and operatively connected to the clutch which the '439 claims assists the stability of the motorcycle at slow speeds and reduces wobble of the front wheel on rough terrain.

While these two more recent remote control vehicles seem to represent an improvement over the prior art motorcycles which used gravity shifting steering, applicants believe there is still room for further improvement. More specifically, these vehicles have not proved to be suitable for rugged terrain. Moreover, the turning capability is somewhat limited.

It is an object of the present invention to improve upon the stability of a remote control toy vehicle, particularly a motorcycle.

It is a further object of the present invention to enhance the compatibility of a remote control motorcycle for off-road use, on a wide variety of terrains.

It is another object of the present invention to improve steering versatility of a remote control motorcycle.

SUMMARY OF THE INVENTION

The present invention achieves the above-stated objects for a wheel-supported toy vehicle, such as a remote control toy motorcycle, by using a four-bar linkage to connect the front wheel to the chassis of the motorcycle. The four-bar linkage projects a castering arc ahead of the front wheel so that the front wheel behaves like a conventional castering wheel. That is, the front wheel tends to realign itself with the direction of travel after being deflected by a disturbance in the surface over which the toy vehicle travels. In combination with the counter steering principle, the four-bar linkage substantially improves upon stability, so that the vehicle may be used on a wide variety of off-road, rugged terrains.

In accordance with a preferred embodiment of the invention, the wheel-supported toy vehicle has a chassis with front and rear ends aligned along the longitudinal axis of the toy vehicle. Front and rear wheels operatively connect to and provide support for respective front and rear ends of the chassis. A propulsion drive is supported by the chassis and is drivingly coupled to the rear wheel to propel the toy vehicle forward. Advantageously, the propulsion drive drivingly rotates the rear wheel by a drive chain or a plurality of intermeshing gears. The four-bar linkage connects the front wheel to the front end of the chassis to enable pivotal movement of the front wheel about the castering arc. As stated above, the four-bar linkage is configured such that the castering arc is projected in front of the four-bar linkage and preferably ahead of the front wheel. The chassis supports a steering drive which connects to the front wheel. The steering drive generates steering outputs to initiate and maintain turns during operation of the toy vehicle. A link with first and second ends operatively connects the steering drive to the front wheel. The first end of the link pivotally connects to a forward-most member of the four-bar linkage to deliver the steering outputs from the steering drive to the front wheel, thereby to pivot the front wheel about the castering axis and to initiate a turn.

The four-bar linkage includes left and right spaced members located on opposite sides of the longitudinal axis. Rearwards ends of the spaced members pivotally connect to the front end of the chassis, and the front ends of the spaced members pivotally connect to a front wheel fork coupler, which forms part of the support structure for the front wheel. Preferably, the front wheel coupler includes upper and lower coupling members. Thus, the four-bar linkage is defined by the spaced members, the front end frame of the chassis and the front wheel fork coupler. This structure produces a castering effect for the front wheel.

The castering effect experienced by the front wheel results because the rear ends of spaced members are spaced farther from the toy vehicle's longitudinal axis than are the front ends of the spaced members. As such, a castering arc is projected ahead of the front wheel and it behaves like a castering wheel. Because of the four-bar linkage configuration, a castering arc is created, rather than a castering axis of conventional castering wheels. Stated another way, the castering axis of the four-bar linkage is moveable along an arc. Because of the tendency of a castering wheel to realign itself with the direction of travel, castering wheels are useful in wheeled-vehicles operating over rough terrain in which the wheels may be undesirably deflected out of alignment with the direction of travel. By using a four-bar linkage, the invention locates the castering arc significantly forward of the front wheel. To achieve the same amount of forward spacing for a conventional castering axis would require structural changes to the front wheel which would be unappealing in appearance and depart significantly from the configuration of a full-size motorcycle. Accordingly, the four-bar linkage of the present invention achieves a forward castering effect for the front wheel while still maintaining the appearance and general structure of a full-size motorcycle.

According to another aspect of the invention, the steering drive has a steering servo and a steering rod connected to the link via a linear coil spring. In the alternative, the steering drive may have a motor and clutch mechanism to generate the steering outputs for the link. As the toy vehicle travels in a straight path, the steering rod, the coil spring and the link align with the longitudinal axis. In a turn, the steering rod, the coil spring, and the link generally no longer align with the longitudinal axis.

To initiate and maintain a turn, for instance to the right with respect to a forward facing direction, the steering servo pivots the steering rod to the right of the longitudinal axis. The steering rod elongates the spring and causes the link to also pivot to the right. Consequently, the link pivots the front wheel about the castering arc. Because of the castering effect created by the four-bar linkage, a substantial portion of the front tire pivots right of the longitudinal axis with only the front portion of the front wheel remaining near the longitudinal axis. In effect, the front wheel initially pivots the front wheel as if to turn the toy vehicle to the left according to the counter-steering principle. The counter-steering causes a shift in the center of gravity to the right such that the toy vehicle tilts to the right relative to a vertical axis. The resulting tilt causes the toy vehicle to veer from the straight path to the right. However, once the turn is initiated, the castering effect of the four-bar linkage forces the wheel to pivot to the opposite side of the longitudinal axis and align itself with the direction of travel. In other words, a substantial portion of the front tire is now positioned left of the longitudinal axis with the front portion of the front wheel remaining near the longitudinal axis, with the wheel steered to the right. To return the toy vehicle to a straight path along its longitudinal axis, the steering servo realigns the steering rod with the longitudinal axis and the castering effect realigns the front wheel also with the longitudinal axis such that the toy vehicle travels in a straight path coincident with the longitudinal axis.

Preferably, the steering drive is controlled by radio signals sent by a remote radio transmitter and received by the motorcycle. The invention further contemplates varying the rotational force applied to the link to initiate and maintain the turn. This proportional steering provides different degrees of sharpness, or curvature, to the turns of the vehicle, thereby increasing the turning versatility.

The propulsion drive also responds to radio signals sent by a remote radio transmitter and received by the motorcycle. Accordingly, the forward motion of the toy vehicle is controlled by the operator sending appropriate signals to the toy vehicle. Using a two signal transmitter, the operator can remotely and independently control both the steering and speed of the toy vehicle.

The present invention also contemplates a weighted flywheel assembly housed within and operatively associated with the rear wheel of the toy vehicle. The propulsion drive operatively couples to both the rear wheel and the flywheel assembly, and drivingly rotates both the rear wheel and the flywheel assembly. The flywheel assembly includes a flywheel with a clutch bell, a clutch disk having at least one clutch pad for engaging the clutch bell, and a gear assembly operatively connected to the propulsion drive. The gear assembly rotates the clutch disk such that the clutch pad engages the clutch bell to impart rotational movement to the flywheel. The gear assembly enables the clutch disk and therefore the flywheel to rotate substantially faster than the rear wheel during normal operation of the toy vehicle.

In combination, the four-bar linkage use of the castering effect and the weighted flywheel assembly enhance the stability and controllability of this remote control motorcycle, to such an extent that this toy motorcycle can be used on a wide variety of terrain types, including off-road terrain.

Other aspects and advantages of the invention will become apparent from the following Detailed Description and the accompanying drawings.

DETAILED DESCRIPTION OF THE PREFERRED EMBODIMENTS

Figure 1:
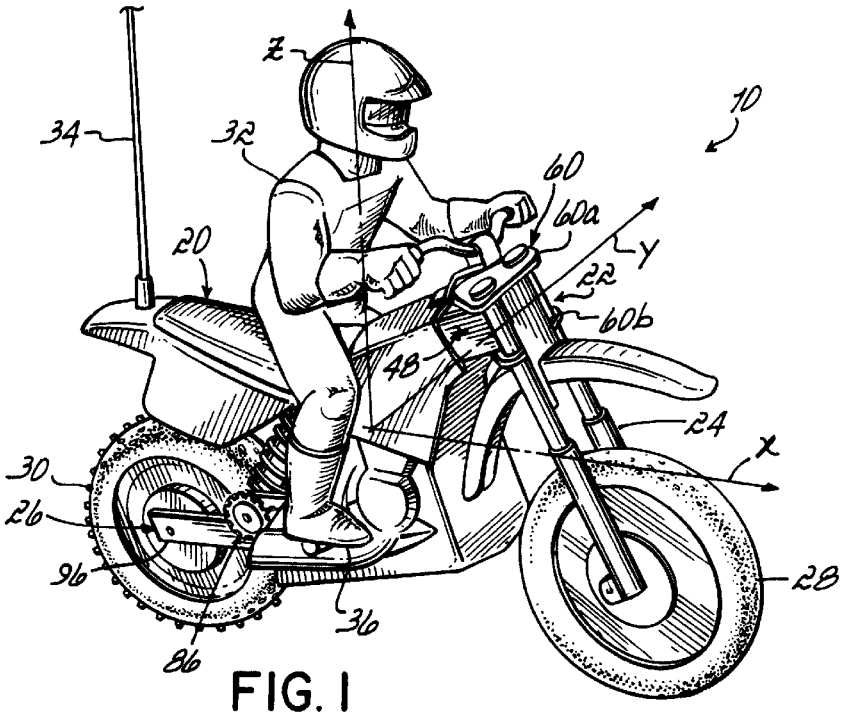
FIG. 1 is a perspective view of a toy motorcycle in accordance with a preferred embodiment of the present invention.

With reference to FIG. 1, a wheel-supported toy vehicle 10, such as a remote control motorcycle, constructed according to a preferred embodiment of the present invention includes a chassis 20, a front suspension 22 including a front fork 24 and a rear suspension 26. The front fork 24 supports a front wheel 28 and rear suspension 26 supports a rear wheel 30.

The toy vehicle 10 may optionally include a rider 32 and an external antenna 4 for receiving radio signals. Further the toy vehicle 10 may include body extensions 36 such as foot pads which support the toy vehicle 10 such that the rear wheel 30 is in contact with the ground when the toy vehicle 10 is on its side. Accordingly, the toy vehicle 10 can, in most situations, right itself when the toy vehicle is laying on its side without intervention from the operator. That is, upon application of power to the rear wheel 30, the toy vehicle 10 begins to spin in an arcuate path until the vehicle 10 becomes upright and is able to operate on both its front and rear wheels 28, 30. This self-righting characteristic is attractive to the operator of the toy vehicle 10 because the operator does not have to walk over to where the toy vehicle is on its side. The application of power to the rear wheel 30 is normally all that is required to get the toy vehicle back into operation.

For purposes of this detailed description, a three-dimensional coordinate system originates from the center of gravity of the toy vehicle 10. As shown in FIG. 1 the coordinate system has three mutually perpendicular axes designated by the letters X, Y, and Z. Axis X projects along the longitudinal axis of the toy vehicle 10 parallel to the ground surface over which the vehicle operates; axis Y projects transverse to the toy vehicle 10; and axis Z projects vertically. Furthermore, axes X, Y, Z define three planes, namely, XZ, XY, and YZ. Throughout this application the terms left or right are taken from the point of view of a forward-facing rider sitting on the toy vehicle 10.

Figure 3:
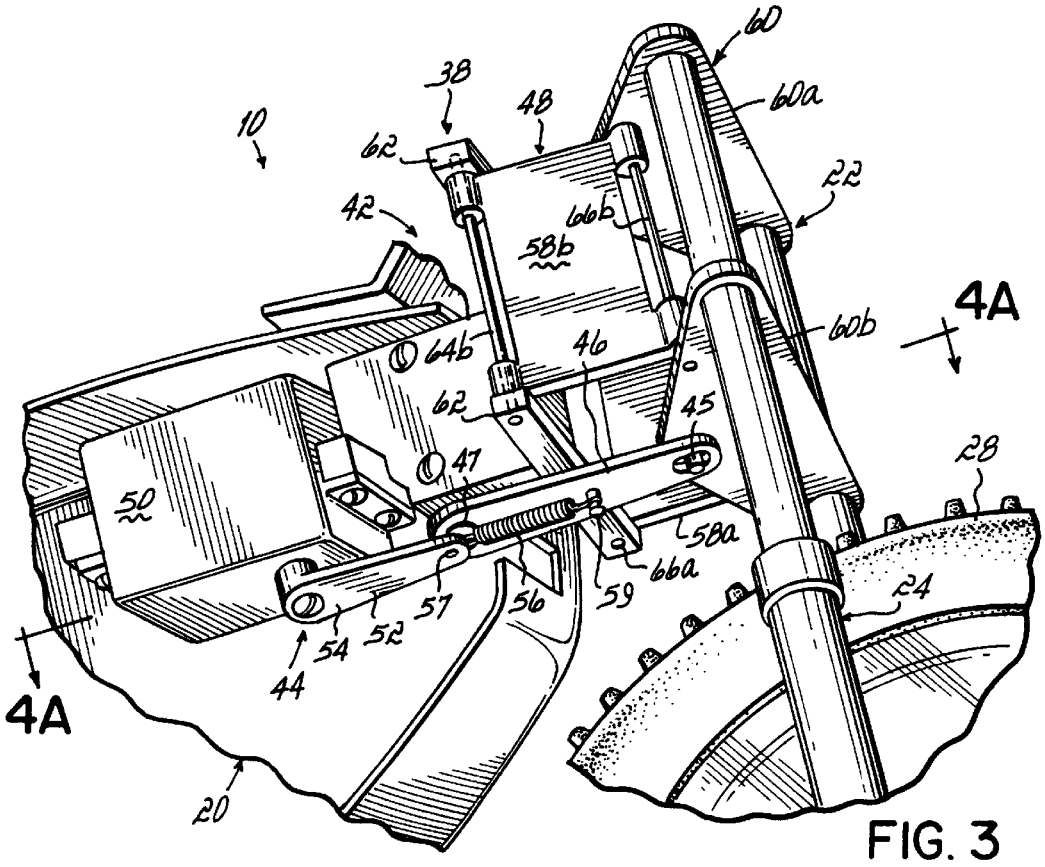
FIG. 3 is a perspective view, partially cut away, of the steering control mechanism for the toy motorcycle shown in FIGS. 1 and 2.
Figure 2:
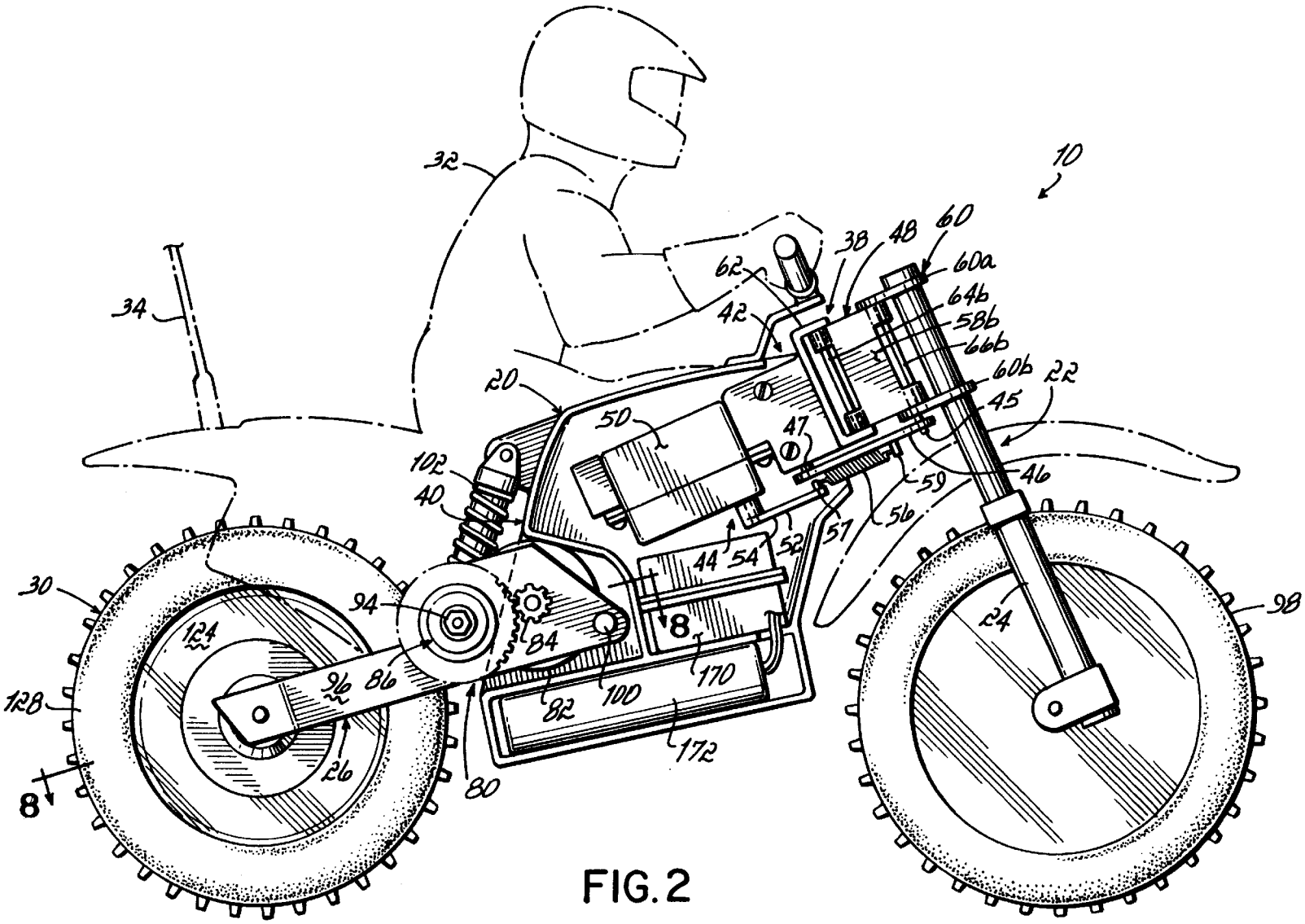
FIG. 2 is a side view, partially cut away, of the toy motorcycle shown in FIG. 1.

With reference to FIGS. 1–3, the chassis 20 has front and rear ends 38, 40, respectively, aligned along longitudinal axis X. The front and rear wheels 28, 30 are operatively connected to and provide support for respective front and rear ends 38, 40 of chassis 20. The toy vehicle 10 further includes a steering system 42 which has a steering drive 44, a link 46, and a four-bar linkage 48. Steering drive 44 includes a steering servo 50 which is supported on the chassis and has a steering rod 52. Steering servo 50 generates steering outputs which pivotally move the steering rod 52 about its connection axis 54 to initiate and maintain a turn of toy vehicle 10 to the left or the right. Link 46 is operatively connected to the steering drive 44 to receive steering outputs from steering servo 50. A first, or forward, end of link 46 is pivotally connected by pivot pin 45 to four bar linkage 48 and a second, or rearward, end of link 46 is pivotally connected by pivot pin 47 to the front end 38 of chassis 20 to deliver the steering outputs to the front fork 24 so as to pivot front wheel 28 to the left or right of the longitudinal axis.

Figure 4A:
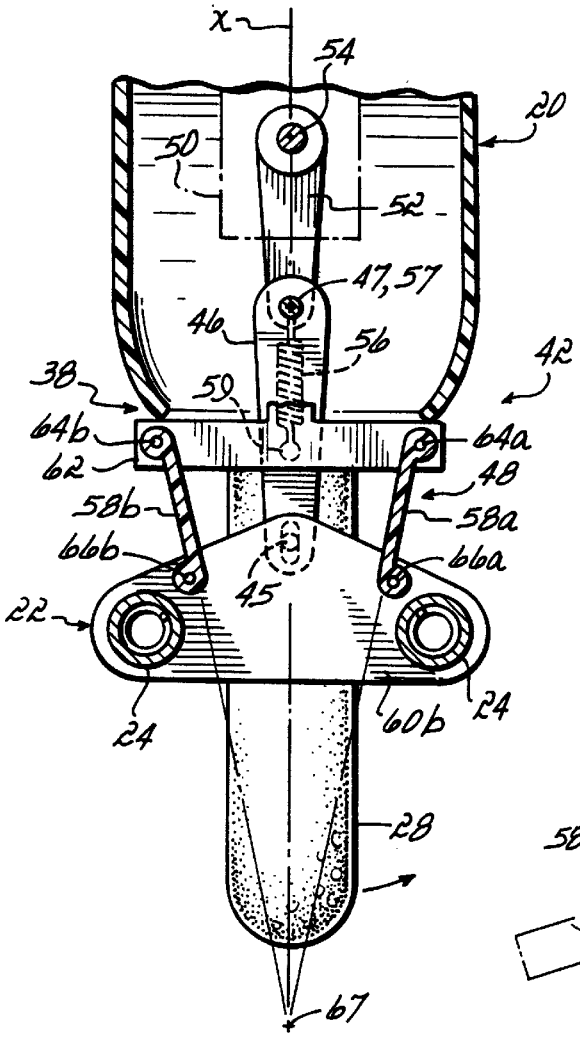
FIG. 4A is a cross-section view of the steering control mechanism of the toy motorcycle shown in FIG. 3 taken along lines 4A—4A.

Steering servo 50 can be any suitable servo device commonly used in the field of remote controlled devices. Steering rod 52 is connected to link 46 via spring 56 at connection points 57 and 59, respectively. Steering rod 52, spring 56, and link 46 are aligned along longitudinal axis X when the toy vehicle is traveling in a straight path as shown in FIGS. 4A and 4B. To initiate a turn, steering servo 50 generates a steering output, steering rod 52 pivots about connection point 54 and out of alignment with longitudinal axis X, thereby pulling on and elongating spring 56. As such, spring 56 pivots link 46 out of alignment with longitudinal axis X and pivots the front fork 24 so as to cause front wheel 28 to pivot as well.

The four-bar linkage 48 connects front wheel 28 to front end 38 to enable pivotal movement of the front wheel 28. More specifically, the four-bar linkage 48 is formed by left and right spaced members 58*a*, 58*b*, a front wheel fork coupler 60, and front end frame 62. Spaced members 58*a*, 58*b* extend from chassis 20, and more specifically, front end frame 62, to the front wheel fork coupler 60. Preferably, the front wheel fork coupler 60 has two components, namely upper and lower fork couplers 60*a*, 60*b*. The rear ends of spaced members 58*a*, 58*b* pivotally connect to front end frame 62 with left and right rear pins 64*a*, 64*b*. The front ends of spaced members 58*a*, 58*b* pivotally connect to upper and lower fork couplers 60*a*, 60*b* with left and right front pins 66*a*, 66*b*, as shown in FIGS. 3 and 4A.

With reference to FIG. 4A, the rear ends of spaced members 58*a*, 58*b* are spaced farther from longitudinal axis X than are the front ends of the spaced members. As such, and in accordance with principles of the invention, the front wheel 28 behaves like castering wheel. Castering wheels inherently want to pivot to align themselves with the direction of travel. That is, upon being deflected out of alignment with the direction of travel, a castering wheel realigns itself with the direction of travel without application of any external aligning forces. Therefore, castering wheels are useful in wheeled-vehicles operating over rough terrain in which the wheels may be undesirably deflected out of alignment with the direction of travel. Conventionally, the castering effect is achieved by physically positioning the wheel's pivoting axis ahead of the contact point of the wheel with the ground. However, the placement of a physical castering axis in front of the front wheel of a remote controlled vehicle, such as a toy motorcycle, would be unappealing in appearance and depart significantly from the configuration of a real motorcycle. Accordingly, the four-bar linkage 48 of the present invention achieves the castering effect for front wheel 28 while still maintaining the appearance of a real motorcycle.

Figure 5A:
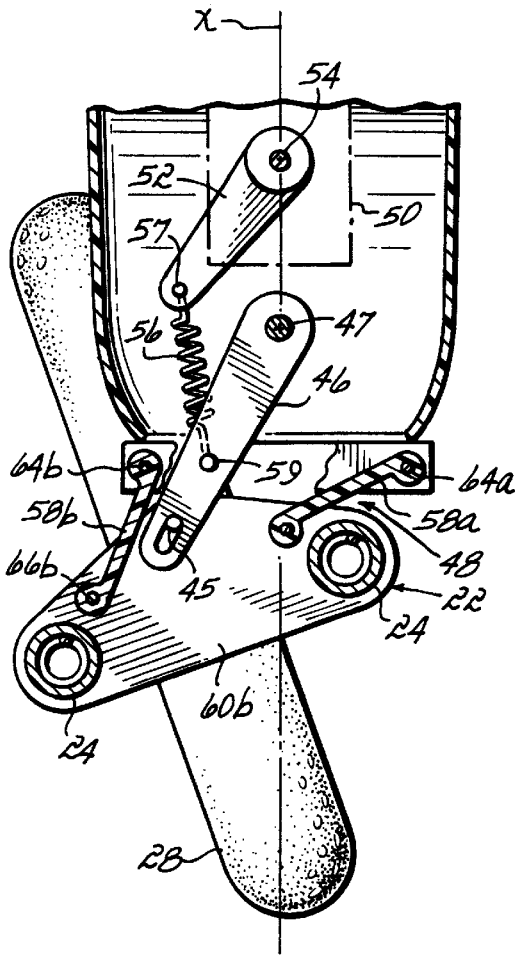
FIG. 5A is a cross sectional view of the toy motorcycle similar to FIG. 4A showing the front wheel (shown in phantom) pivoted to the left of the longitudinal axis.
Figure 6A:
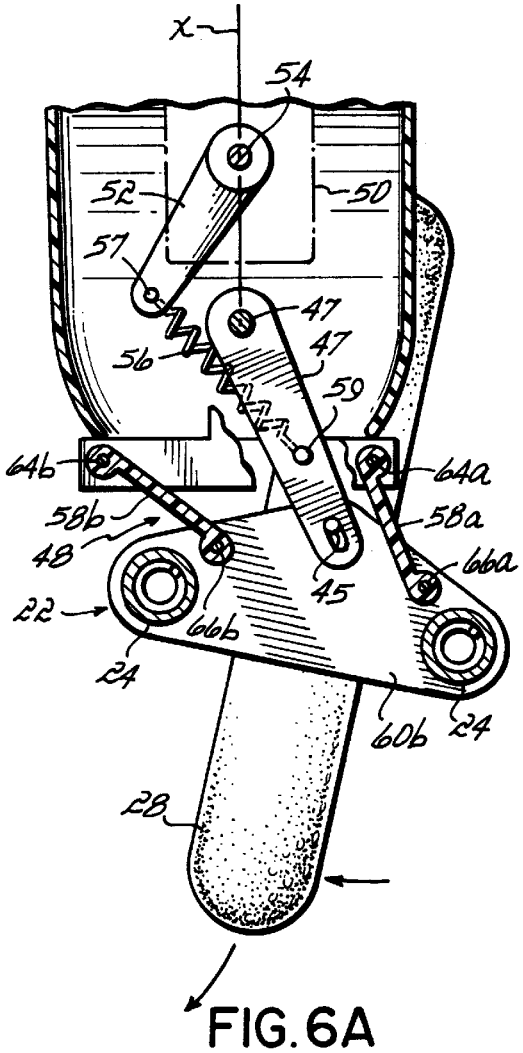
FIG. 6A is a cross sectional view of the toy motorcycle similar to FIG. 4A showing the front wheel (shown in phantom) pivoted to right side of the longitudinal axis.

The steering operation of toy vehicle 10 is explained with reference to FIGS. 4A through 6B and, more specifically, for initiating and maintaining a right turn relative to a forward facing direction. FIGS. 5 and 6 are top views while FIGS. 5A and 6A are bottom views taken along lines 4A—4A of FIG. 3. It will be appreciated that toy vehicle 10 can make left turns as well and that the following discussion is also relevant to the mechanics of a left turn. With specific reference to FIGS. 4A and 4B, front wheel 28 is aligned along longitudinal axis X such that toy vehicle 10 travels along a straight path (FIG. 4B) coincident with longitudinal axis X.

Figure 5B:
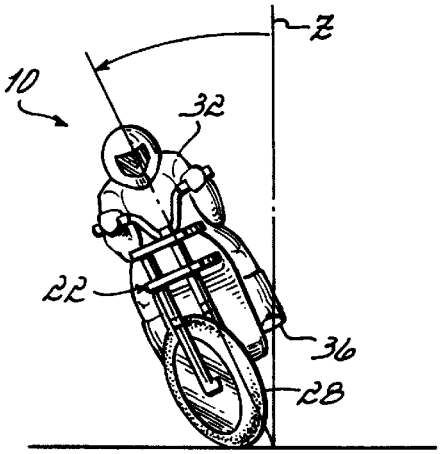
FIG. 5B is a front view of the toy motorcycle of FIG. 5 showing the toy motorcycle initiating a right hand turn.
Figure 6B:
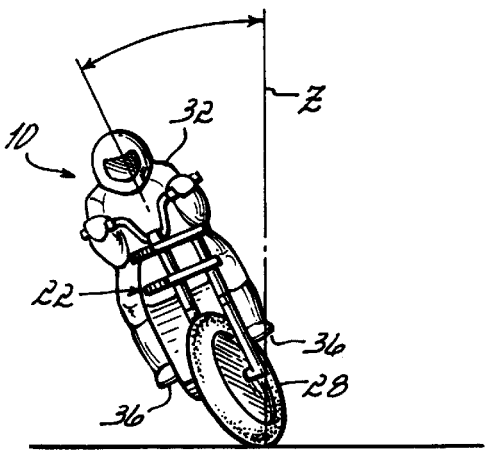
FIG. 6B is a front view of the toy motorcycle of FIG. 6 showing the toy motorcycle in a fully established right turn.

To initiate a right turn and with reference to FIGS. 5, 5A, and 5B, steering servo 50 pivots or rotates steering rod 52 to the right of longitudinal axis X, relative to a forward facing direction, thereby elongating spring 56 which causes link 46 to also pivot or rotate to the right of longitudinal axis X. As shown in FIG. 5A, rotation of link 46 initially causes front fork 24 and front wheel 28 to pivot about castering arc 68 to the right of longitudinal axis X. This pivotal movement of front wheel 28 causes a shift in the center of gravity to the right, which causes the toy vehicle 10 to tilt, or fall, to the right relative to vertical axis Z as shown in FIG. 5B. In effect, the front wheel 28 initially pivots to the right in a direction opposite to the direction of the desired turn, i.e., to the right, in accordance with the principle of counter-steering. The resulting tilt of toy vehicle 10 then causes the vehicle to veer from the straight path to the right of the longitudinal axis X, relative to a forward facing direction, as shown in FIG. 6B.

Once the right turn is initiated and with reference to FIGS. 6, 6A, 6B, the castering effect of the four-bar linkage, however, forces the wheel to pivot in the oppose direction and align itself with the direction of travel, i.e., a right-hand arcuate path. With reference to FIG. 6B, the toy vehicle 10 is tilted to the right side relative to vertical axis Z and the front wheel 28 is pivoted into the direction of the turn. With reference to FIG. 6A, steering rod 52 retains its position to the right side of longitudinal axis X. However, because front wheel 28 has pivoted to the other side (relative to FIG. 5A) spring 56 is further elongated to apply a greater restoring force to link 46 and four-bar linkage 48. To return the toy vehicle 10 to a straight path along its longitudinal axis, the steering servo 50 pivots steering rod 52 so that it aligns with longitudinal axis X (FIG. 4A). Once steering rod 52 aligns with the longitudinal axis X, the castering effect pivots front wheel 28 to align it with the longitudinal axis X such that the toy vehicle 10 travels in a straight path coincident with longitudinal axis X.

Although the above description is directed to the specific four-bar linkage shown in the figures, it can be appreciated that any variety of different moveable linkages would work, so long as the linkage projects the castering axis ahead of the front wheel would work. For instance, a pair of connecting members extending from the chassis 20 to the front wheel 28 that enables the front wheel to have a castering effect may be used.

Figure 7:
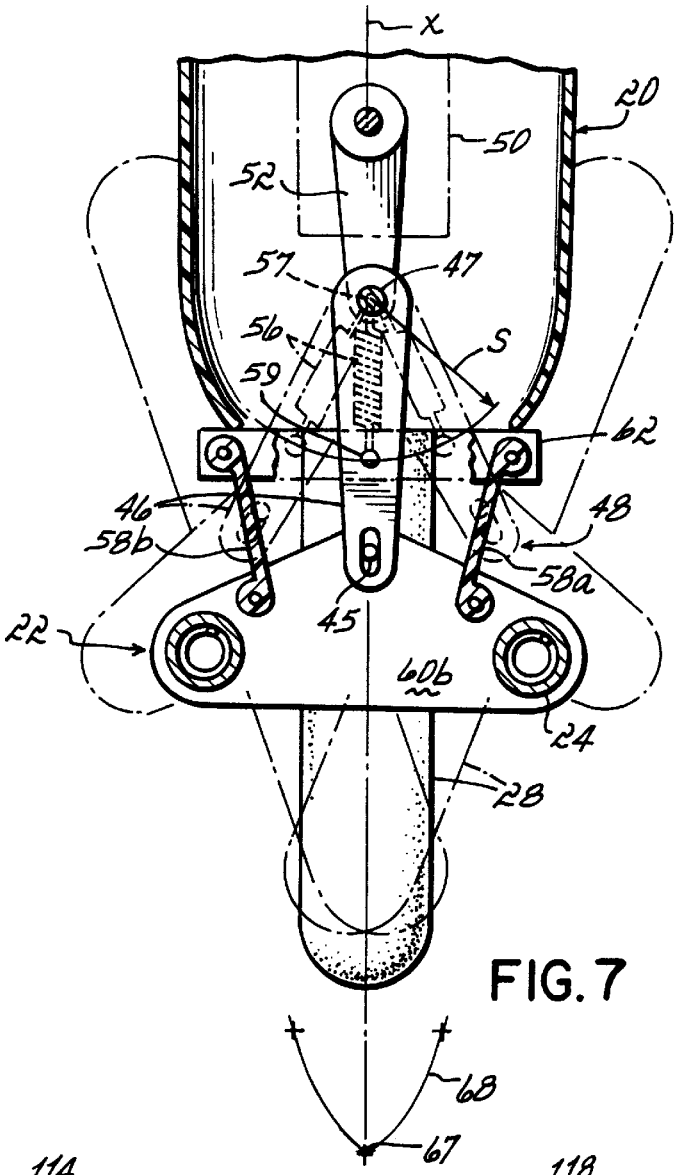
FIG. 7 is a cross sectional view of the steering control mechanism of the toy motorcycle similar to FIG. 4A.

With reference to FIG. 7, spring 56 has a length S when steering rod 52 is aligned with link 46. Advantageously, steering rod 52 is adapted such that the connection point 57 between it and spring 56 coincides with the pivot pin 47 of link 46 at front end 38 of chassis 20. As such, if an obstacle, such as a rock, deflects the front wheel 28 to either side of the longitudinal axis X, the length S of spring 56 will remain constant and the castering effect will allow the front wheel to realign itself with longitudinal axis X without being influenced by spring 56. This configuration enables the toy vehicle 10 to travel over rough terrain and still maintain a straight path even when the front wheel 28 is deflected off course. As such, the invention provides the toy vehicle 10 with improved stability and performance, especially in off road type conditions.

Figure 4C:
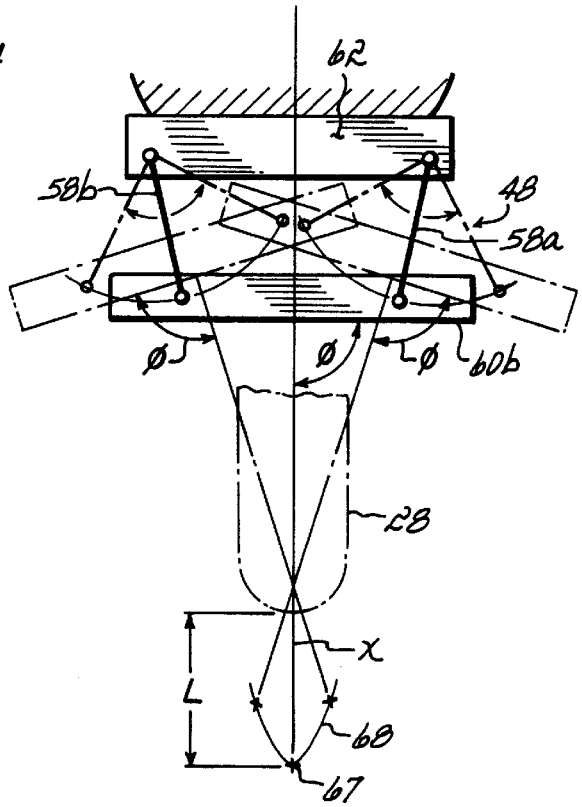
FIG. 4C is a schematic representation of the four-bar linkage of the toy vehicle of FIG. 1 illustrating the projected castering arc.
Figure 4B:
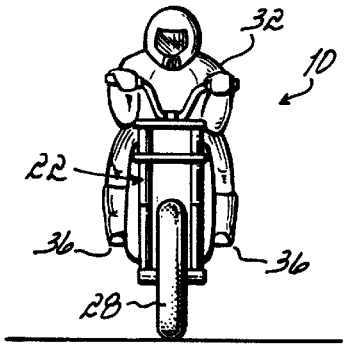
FIG. 4B is a front view of the toy motorcycle of FIG. 1 shown with its front wheel aligned along a longitudinal axis.

As shown schematically in FIG. 4C four-bar linkage 48 pivots front wheel 28 about castering arc 68 which is projected a distance L in front of the contact point of front wheel where angle $\phi$ (equals 90 degrees. As front wheel 28 pivots from left to right, the projected pivot point moves along a castering arc 68. The castering arc 68 contrasts the fixed-positioned castering axis common to most castering wheels, yet still achieves the desirable castering effect. As such, the invention has improved stability and performance, especially in off road type conditions.

If the structure of the four-bar linkage 48 is modified, for instance changing the spacing of the front ends of spaced members 58*a*, 58*b* relative to the longitudinal axis, the distance L will change. As the distance L changes the magnitude of the castering effect changes as well. For example, if the front ends of spaced members 58*a*, 58*b* are moved very close to one another, thereby reducing the distance L, the castering effect will be diminished and the toy vehicle 10 may be more susceptible to turning over in rough terrain as the front wheel 28 is deflected from the direction of travel.

Figure 8:
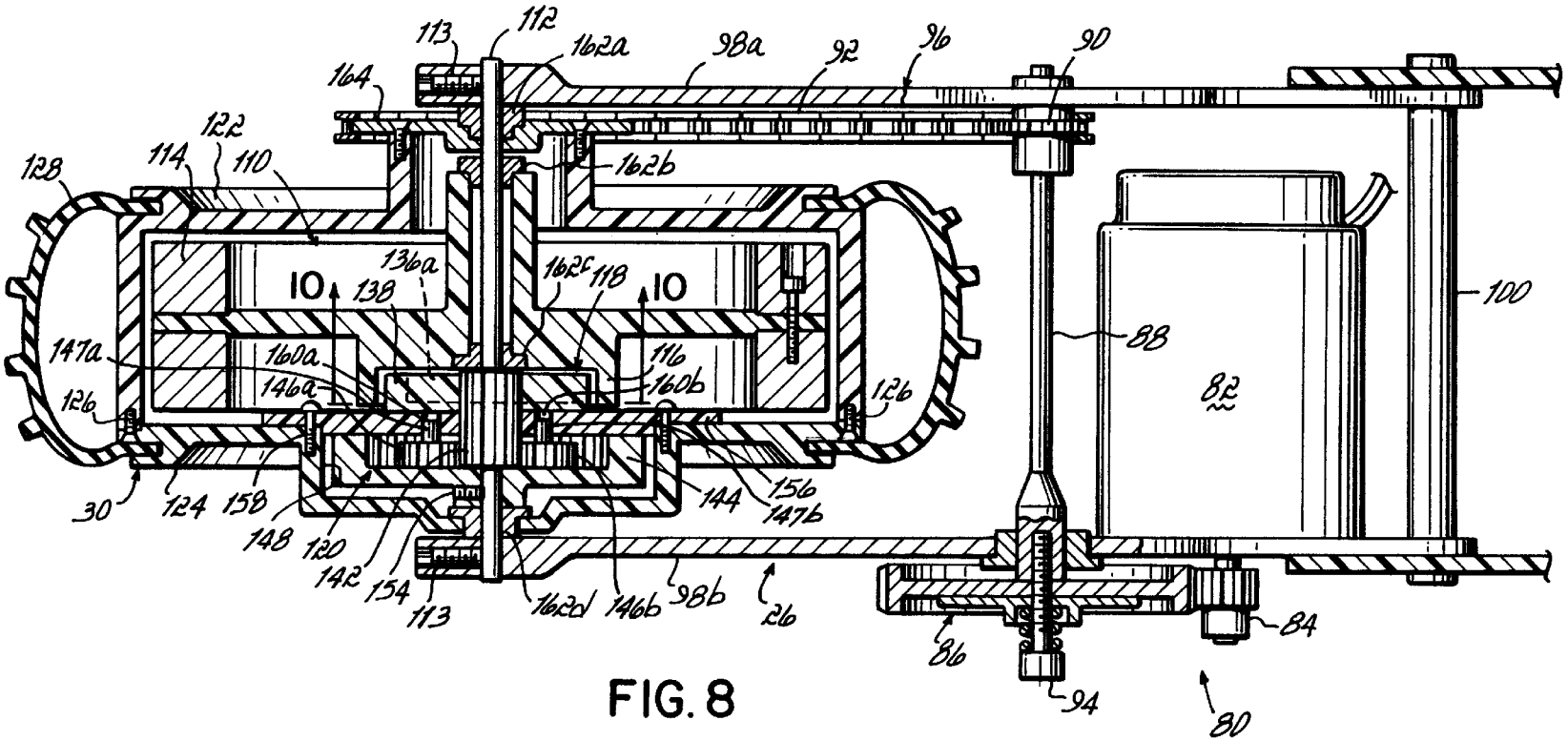
FIG. 8 is a cross-sectional view taken along lines 8—8 of FIG. 2 showing the gyroscopic flywheel and rear wheel of a first preferred embodiment of the present invention.

With reference to FIGS. 2 and 8, toy vehicle 10 includes a propulsion drive 80 which is supported by the chassis 20 and is drivingly coupled to the rear wheel 30. Propulsion drive 80 includes a motor 82 which turns gear 84. Motor 82 may be any suitable lightweight motor but typically is a battery powered DC motor or a lightweight internal combustion engine. Propulsion drive 80 further includes a clutch 86 which rotatively engages gear 84 for transmitting rotational movement to shaft 88. Shaft 88 has front drive gear 90 which engages chain 92. Clutch 86 permits a certain amount of slippage such that when torque over a certain level is applied from motor 82, the torque is not abruptly transmitted to shaft 88 and chain 92. The slippage in clutch 86 helps to extend the life of the drive train parts by not subjecting them to abrupt and potentially damaging amounts of torque from motor 82. Screw 94 can be adjusted so that the amount of slippage can be changed to suit the needs of the operator or to account for different terrain. For instance, if immediate throttle response is desired, the operator can tighten screw 94 to minimize slippage, but with the increased risk of damaging components of the drive train.

With continued reference to FIGS. 2 and 8, rear wheel 30 is connected to toy vehicle 10 by swing arm 96 having spaced extension arms 98*a*, 98*b*. Swing arm 96 pivots about pivot member 100. A shock absorber 102 is operatively connected from the chassis 20 to swing arm 96 to control the motion of the swing arm about pivot member 100 when rear wheel 30 encounters a disturbance, like a rock, during the of operation of toy vehicle 10.

Figure 9:
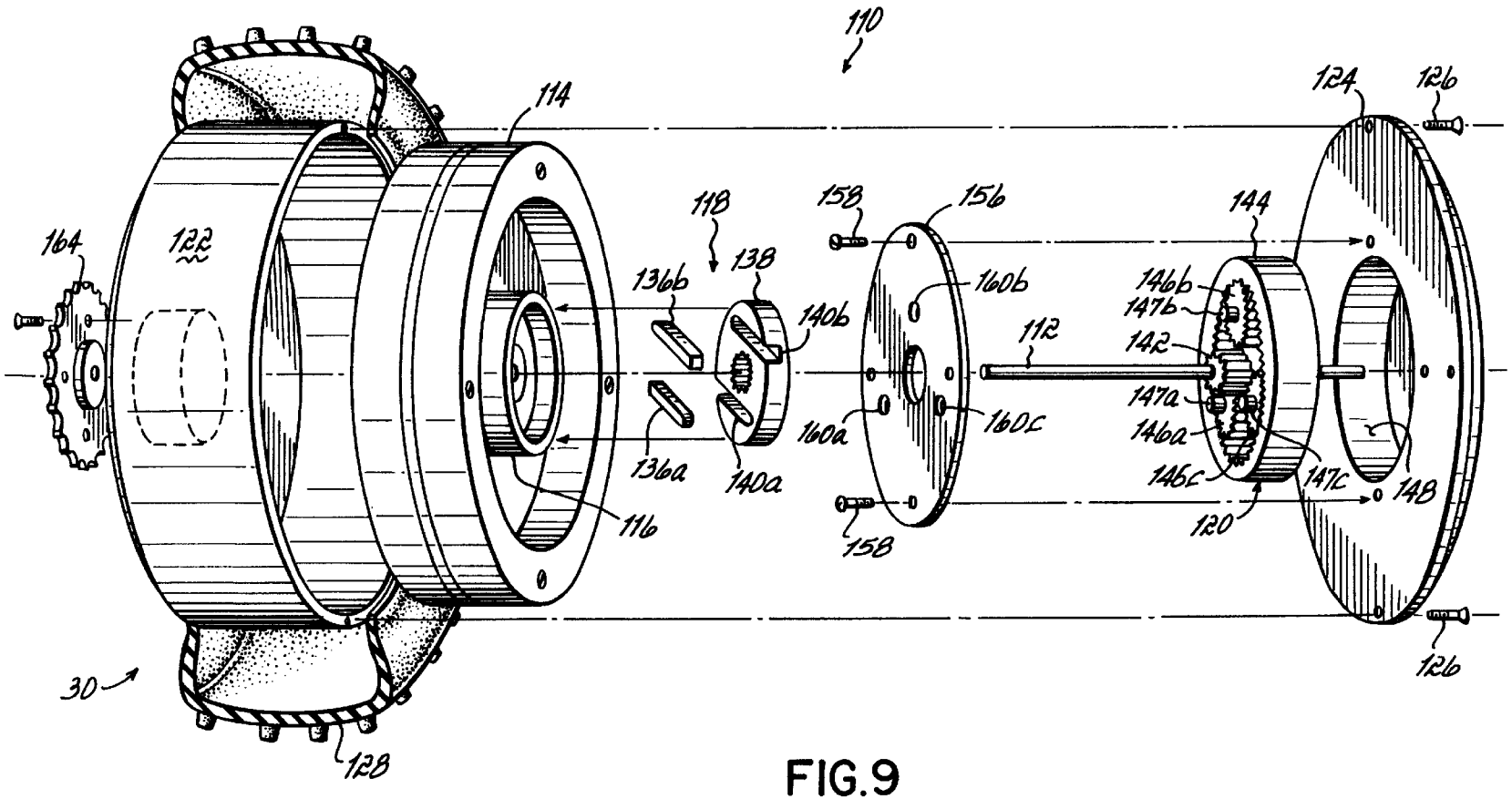
FIG. 9 is an exploded perspective view of the gyroscopic flywheel and rear wheel of a toy motorcycle of FIGS. 1 and 8.

With reference to FIGS. 8 and 9, a weighted flywheel assembly 110 is housed within rear wheel 30. The flywheel assembly 110 enhances the stability and performance of toy vehicle 10, especially in operation over rough terrain. As described in greater detail below, the flywheel assembly 110 spins substantially faster than the rear wheel during operation of toy vehicle to provide a stabilizing gyroscopic effect.

Flywheel assembly 110 is operatively connected to rear wheel 30 such that the flywheel assembly operates at a rotational speed substantially greater than the rotational speed of the rear wheel during operation of the toy vehicle 10. Rear wheel 30 and flywheel assembly 110 is rotatively attached to swing arm 96 with non-rotating axle 112. That is, axle 112 is fixed in both extension arms 98*a*, 98*b* by set screws 113 and does not rotate along with rear wheel 30 and flywheel assembly 110.

Flywheel assembly 110 includes flywheel 114 with clutch bell 116, clutch assembly 118, and gear assembly 120. The entire flywheel assembly 110 resides within wheel housing 122 and wheel cap 124 which is secured by screws 126. Rear wheel 30 has a tire 128 encircling the exterior surface of wheel housing 122. Although a tire of solid construction could be used on rear wheel 30, the tire 128 is preferably of hollow construction because it provides shock absorption for small imperfections in the surface over which the toy vehicle 10 is operating in addition to the shock absorption provided by shock absorber 102.

Figure 10:
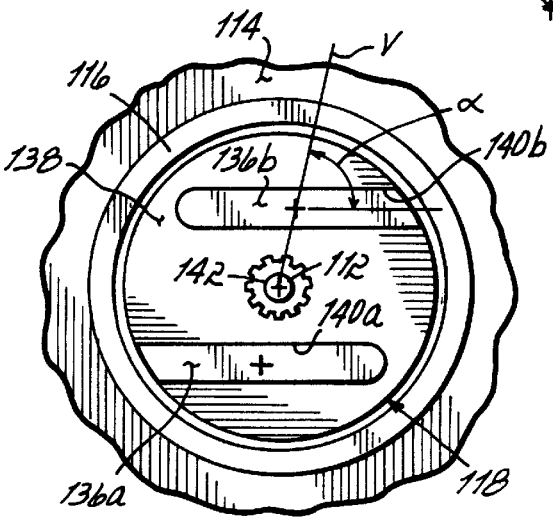
FIG. 10 is a view similar to FIG. 10 showing the clutch mechanism disengaged from the gyroscopic flywheel of the toy motorcycle of FIG. 1.
Figure 11:
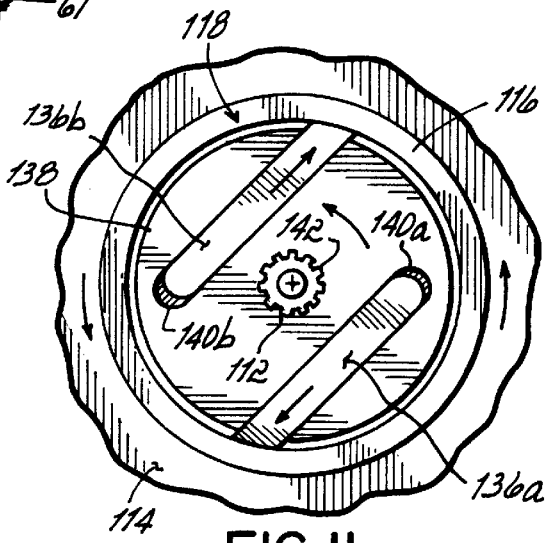
FIG. 11 is a view of the clutch mechanism engaging the gyroscopic flywheel of the toy motorcycle of FIG. 8 taken along lines 10—10.

Clutch assembly 118 includes clutch pads 136*a*, 136*b* and clutch disk 138. Clutch disk 138 has slots 140*a*, 140*b* into which clutch pads 136*a*, 136*b* can slidingly move. Clutch disk 138 also has a through-hole adapted to fit over and engage a central gear 142 of gear assembly 120. Clutch assembly 118 resides within clutch bell 116 so that clutch pads 136*a*, 136*b* can slidingly engage clutch bell 116 to rotate flywheel 114. With reference to FIG. 10, clutch pads 136*a*, 136*b* are tilted an angle a with respect to reference line V which extends from the center of axle 112 through the center of gravity of the clutch pads. Changing the angle a alters the clutch assembly's engagement of clutch bell 116. Advantageously, angle a ranges between about 60 to about 90 degrees. Most advantageously, angle a ranges between about 75 to about 85 degrees. When clutch disk 138 is stopped or rotating slowly, clutch pads 136*a*, 136*b* reside fully within slots 140*a*, 140*b* (FIG. 10), i.e., they do not contact clutch bell 116. When clutch disk 138 rotates sufficient fast enough, clutch pads 136*a*, 136*b* are forced out of slots 140*a*, 140*b* by centrifugal force and slidingly engage the interior surface of clutch bell 116 (FIG. 11). The clutch pads 136*a*, 136*b* thereby rotate flywheel 114 at a speed substantially equal to that of clutch disk 138. When power is not applied to rear wheel 30, the flywheel 114 continues its rotation independent of the rotation of the rear wheel to provide continuing gyroscopic stability to toy vehicle 10. To that end, as clutch disk 138 begins to slow down, the continued rotation of clutch bell 116 essentially pushes clutch pads 136*a*, 136*b* back into their respective slots 140*a*, 140*b* so that flywheel 114 can spin free of external forces which may tend to slow it down.

As shown in FIGS. 8 and 9, gear assembly 120 includes planetary gear 144, satellite gears 146*a*, 146*b*, 146*c*, and the central gear 142. Gear assembly 120 resides within recess 148 of wheel cap 124. Planetary gear 144 is fixedly attached to axle 112 by set screw 154. As such planetary gear 144 is stationary like axle 112 and does not rotate when rear wheel 30 rotates. Gear plate 156 and screws 158 secure gear assembly 120 into recess 148. Satellite gears 146*a*, 146*b*, 146*c* rotate respectively about their axles 147*a*, 147*b*, 147*c* which engage gear plate 156 via throughholes 160*a*, 160*b*, 160*c*. Therefore, when rear wheel 30 is rotated by chain 92, gear plate 156 rotates satellite gears 146*a*, 146*b*, 146*c*. Satellite gears 146*a*, 146*b*, 146*c* thereby rotate clutch disk 138 via central gear 142. Advantageously, the size of planetary gear 144, satellite gears 146*a*, 146*b*, 146*c*, and central gear 142 are selected such that one revolution of rear wheel 30 equals between about six to about nine revolutions of clutch disk 138. Most advantageously, the ratio of clutch disk rotation to rear wheel rotation is about seven to one. To ensure that the rear wheel 30 and flywheel assembly 110 rotate freely about fixed axle 112, bearings 162*a*, 162*b*, 162*c*, 162*d* (FIG. 8) may be used.

During operation, chain 92 transmits power to rear wheel 30 via rear drive gear 164 such that the rear wheel rotates about fixed axle 112. At the same time gear plate 156 also rotates along with rear wheel 30 as it is fixed to wheel cap 124. As gear plate 156 rotates, it rotates satellite gears 146*a*, 146*b*, 146*c* about stationary planetary gear 144. The satellite gears 146*a*, 146*b*, 146*c* in turn rotate central gear 142. Central gear 142 thereby rotates clutch disk 138. As explained above, clutch disk 138 spins substantially faster than rear wheel 30 and clutch pads 136*a*, 136*b* slidingly engage the interior surface of clutch bell 116. As clutch disk 138 spins faster, more and more force is applied to clutch pads 136*a*, 136*b* until flywheel 114 begins to rotate in unison with clutch disk 138. Eventually flywheel 114 spins at a speed substantially equal to that of clutch disk 138.

Although the toy vehicle could function without the assistance of an operator, it is contemplated that an operator will remotely control the toy vehicle by means of a radio-control transmitter (not shown). The radio-control transmitter will enable the operator to steer the toy vehicle 10 and control its forward speed. Accordingly, toy vehicle 10 may include a two-way radio receiver 170 coupled with external antenna 34 for receiving steering and acceleration commands from the radio-control transmitter as shown in FIG. 2. Radio receiver 170, steering servo 50, and motor 82 receive their requisite electric power from power supply 172 which is operatively connected to each component. Power supply 172 may be any suitable power source, such as rechargeable batteries. The requisite power rating of power supply 172 will depend upon the size of steering servo 50 and motor 82. The radio controlled steering servo provides proportional steering such that the amount of turn requested by the operator can vary between slight turns to very sharp turns. Proportional steering of this invention contrasts the non-proportional steering of prior remote control motorcycles in which the steering output was either full on or straight with no variation in between. The proportional steering of the invention provides the operator with a more realistic experience of a full size motorcycle.

While the steering drive 44 of the previously described embodiment is suitable for generating steering outputs to steer toy vehicle 10, it is contemplated that other steering mechanisms may be used to provide steering for the toy vehicle. Therefore in accordance with another embodiment of the invention and with reference to FIG. 12, steering drive 44 includes steering motor 180 and housing 182 which encloses gear assembly 184. Gear assembly 184 is operatively connected to clutch mechanism 186 such that torque from steering motor 180 is transmitted to the clutch mechanism. Clutch mechanism 186 rotates clutch output gear 188 which rotates pivot gear 190 about pin 192. Pin 192 couples pivot gear 190 and link 46 to housing 182. Motor 180 is controlled to rotate in either the counterclockwise or clockwise direction to impart left or right turning to link 46. As described above with respect to the first embodiment (FIGS. 5 through 6B), link 46 pivots about pin 192 and thereby pivots four-bar linkage 48 to initiate and maintain a turn in the desired direction. Clutch mechanism 186 behaves much like spring 56 in that once a turn is initiated and front wheel 28 aligns itself with the direction of the turn (FIG. 6), the clutch mechanism maintains a steering force on link 46 similar to the elongated spring 46 in FIG. 6A. Likewise, once the steering force is removed, link 46 realigns with longitudinal axis X and toy vehicle 10 resumes forward motion along a straight path coincident with longitudinal axis X.

Figure 12:
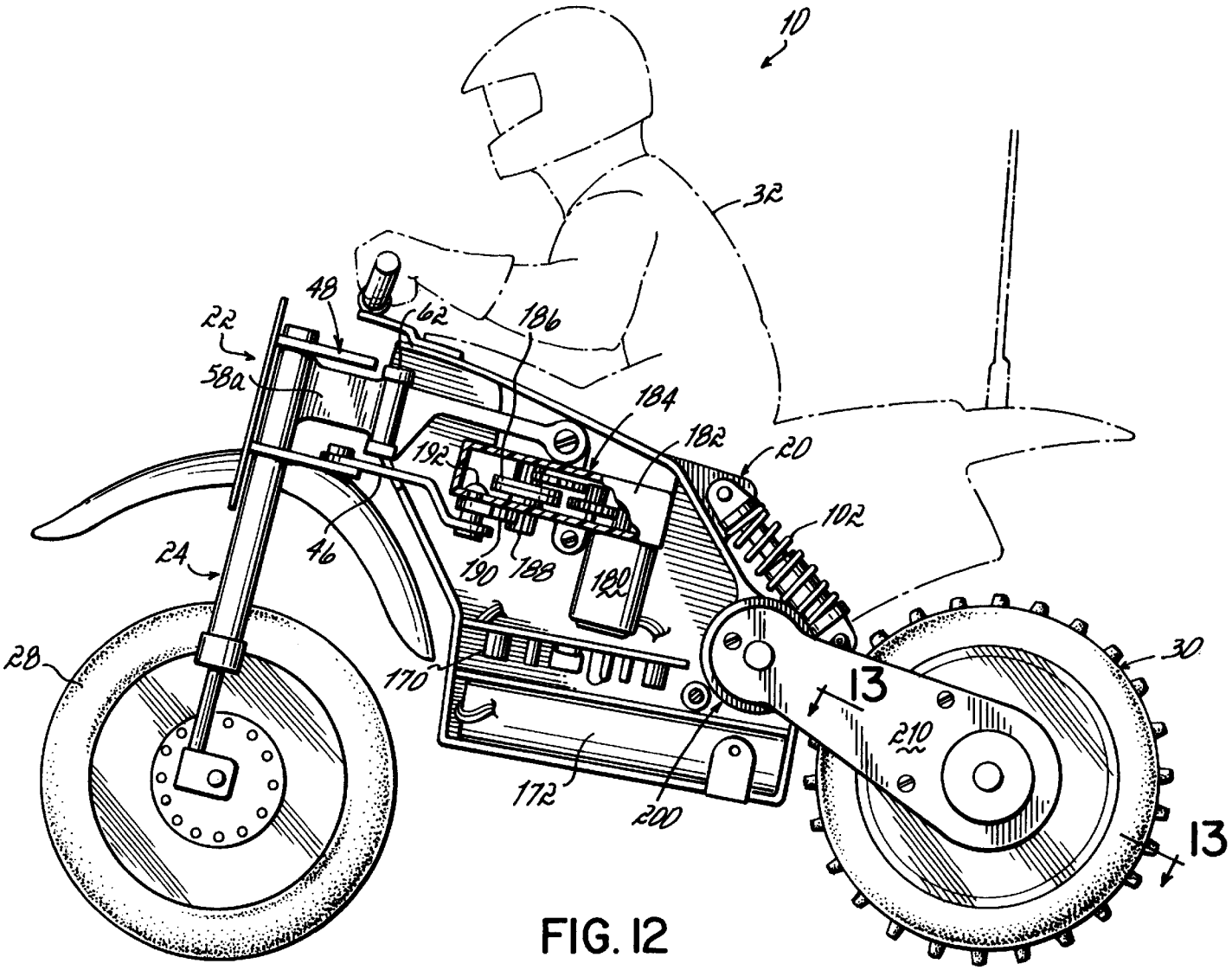
FIG. 12 is a plan view, partially cut away, of a second preferred embodiment of the invention.

Toy vehicle 10 shown in FIG. 12 uses an alternate propulsion drive 200. More specifically and with reference to FIGS. 13 and 14, propulsion drive 200 includes a motor 202 transmitting power through drive gear 204 to gear drive assembly 206. Gear drive assembly 206 thereby rotates rear wheel 30 to propel toy vehicle 10 forward. Gear drive assembly 206 is enclosed in housing 208 and housing plate 210 for protection against debris which may clog or damage the gear drive assembly. Motor 202 may be any suitable lightweight motor but is typically is a battery powered DC motor or a lightweight internal combustion engine. Motor 202 rotates drive gear 204 which in turn rotates a plurality of intermeshing transmission gears 212*a*, 212*b* and bi-level gear 214. Bi-level gear 214 includes a small diameter gear 214*a* which drives rim gear 216 which is mounted to spindle 218 of wheel housing 219. Accordingly, rim gear 216 rotatingly drives rear wheel 30 and an associated flywheel assembly 220.

Figure 13:
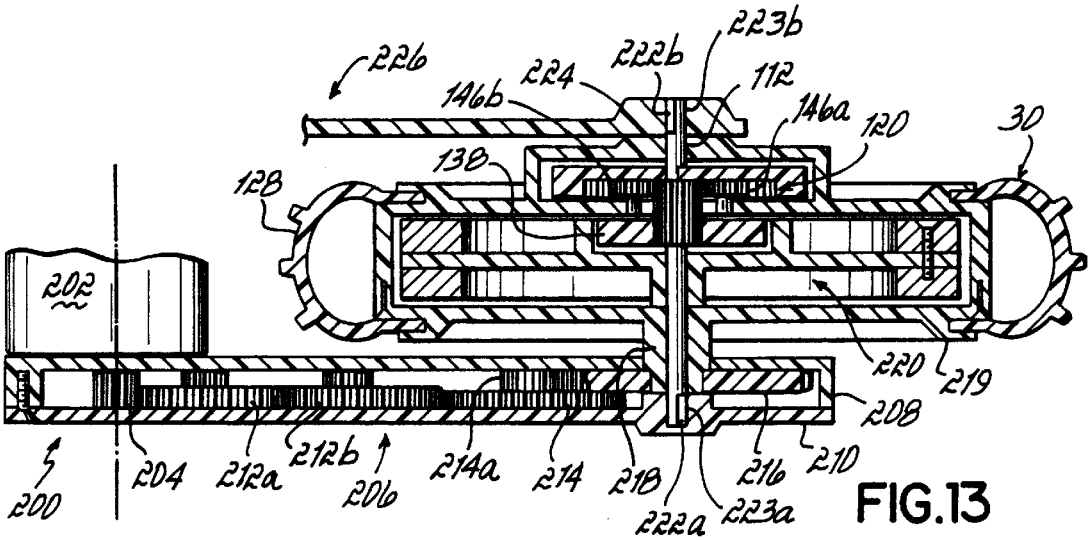
FIG. 13 is a cross-sectional plan view taken along lines 13—13 of FIG. 12 showing the gyroscopic flywheel and rear wheel according to the second preferred embodiment of the present invention.
Figure 14:
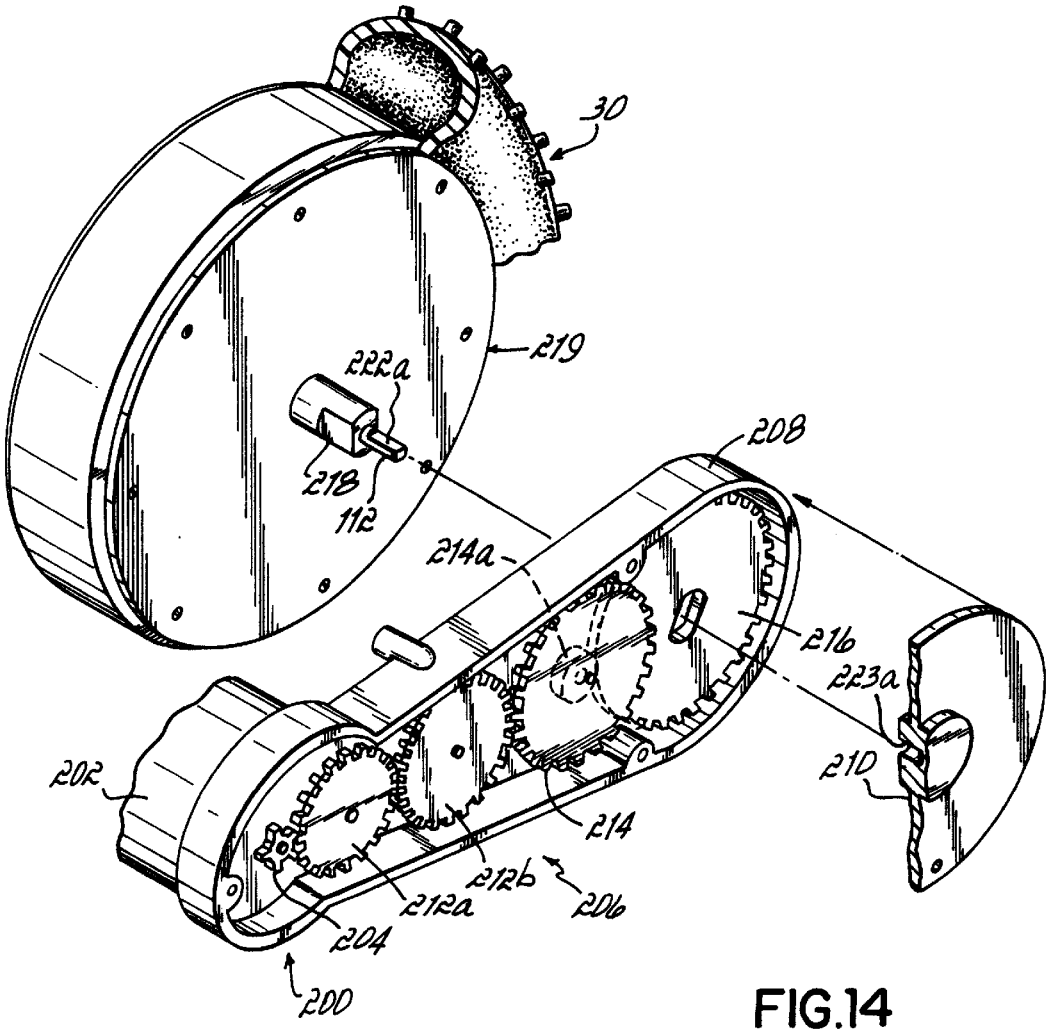
FIG. 14 is a exploded perspective view of the gear train and rear wheel of the toy motorcycle shown in FIG. 13.

The flywheel assembly 220 of FIG. 13 is similar in design and operation as flywheel assembly 110 of FIG. 8 with only a few differences. More specifically, axle 112 has slotted ends 222*a*, 222*b* inserted respectively into keyed holes 223*a*, 223*b* in housing plate 210 and extension arm 224 of swing arm 226. Consequently, screws 113 are not required to fixed axle 112 in place. Rear wheel 10 and flywheel assembly 220 do not use bearings 162*a*, 162*b*, 162*c*, 162*d* to support those components. The rotating components simply rotate about and in contact with fixed axle 112. The rear wheel 30 and the flywheel assembly 220 may be constructed more narrowly than their counterparts of FIG. 8 reflecting potential use in a smaller and more lightweight version of the toy vehicle 10. Finally, housing 208 and swing arm 226 pivot about an axis running coincident with the longitudinal axis of motor 202.

Those skilled in the art will recognize that the embodiment illustrated is not intended to limit the invention. Indeed, those skilled in the art will recognize that any other alternative embodiments may be used without departing from the scope of the invention. For example, while the combination of the four-bar linkage of the front steering and the gyroscopic rear wheel is symbiotic, it is possible to use each separately to improve the performance of a remote control motorcycle. Additionally, one skilled in the art should recognize that any suitable mechanism for imparting motion to the steering mechanism could be used. Additionally, while an electrically powered motorcycle is shown, it will be appreciated that an internal combustion engine could be used.

What is claimed is:

1. A wheel-supported toy vehicle comprising:

a chassis having front and rear ends aligned along a longitudinal axis;

front and rear wheels operatively connected to and providing support for the respective front and rear ends;

a propulsion drive supported by the chassis and drivingly coupled to the rear wheel;

a four-bar linkage connecting the front wheel to the front end to enable pivotal movement of the front wheel about a castering arc, the four-bar linkage being configured such that the castering arc is projected in front of the four-bar linkage;

a steering drive supported on the chassis, the steering drive adapted to generate steering outputs; and a link having first and second ends, the second end of the link being operatively connected to the steering drive to receive the steering outputs and the first end of the link being pivotally connected to the four-bar linkage to deliver the steering outputs thereto, thereby to pivot the front wheel about the castering arc, and initiate a turn of the toy vehicle.

2. The vehicle of claim 1 wherein the four-bar linkage further comprises:

a front end frame supported by the front end of the chassis;

a front wheel fork coupler;

a pair of spaced members extending from the front end frame to the front wheel fork coupler, the members having first ends pivotally connected to the front end frame and second ends pivotally connected to the front wheel fork coupler, the first ends of the members being connected at spaced positions located farther from the longitudinal axis than the respective connection points of the second ends of the members.

3. The vehicle of claim 2 wherein the front wheel fork coupler includes upper and lower fork couplers.

4. The vehicle of claim 3 wherein the steering drive operatively controls the link to affect the steering of the vehicle to the left or to the right with respect to a forward facing direction of the vehicle, so that to initiate a turn to the right of the longitudinal axis, the link pivots to the right, and to initiate a turn to the left of the longitudinal axis, the link pivots to the left.

5. The toy vehicle of claim 1 wherein the steering drive further comprises a servo and at least one spring, the spring operatively connecting the servo to the link.

6. The toy vehicle of claim 5 wherein the servo has a steering rod to which the spring connects, the steering rod and the spring being aligned with the longitudinal axis when the toy vehicle travels in a straight path.

7. The toy vehicle of claim 1 wherein the steering device further comprises a motor and a clutch mechanism, the clutch mechanism operatively connecting the motor to the link.

8. The toy vehicle of claim 1 wherein the propulsion drive drivingly rotates the rear wheel via a plurality of intermeshing gears.

9. The toy vehicle of claim 1 wherein the propulsion drive drivingly rotates the rear wheel via a drive chain.

10. The toy vehicle of claim 1 and further comprising:

a weighted flywheel housed within and operatively associated with the rear wheel; and the propulsion drive operatively couples the wheel and the weighted flywheel for driving both the rear wheel and the flywheel.

11. A wheel-supported toy vehicle comprising:

a chassis having front and rear ends aligned along longitudinal axis;

front and rear wheels operatively connected to and providing support for the respective front ends;

a steering system operatively connecting the front wheel to the front end of the chassis, the steering system adapted to generate a steering force to initiate a turn of the toy vehicle to either the left or right of the longitudinal axis;

a propulsion drive supported by the chassis and drivingly coupled to the rear wheel;

a weighted flywheel housed within and operatively associated with the rear wheel; and a clutch assembly rotatably mounted within the rear wheel and operatively connected to the propulsion drive and adapted to rotate faster than the rear wheel when the propulsion drive is operative;

wherein the clutch assembly rotatingly engages the flywheel at a predetermined rotational speed to thereby rotate the flywheel at a rotational speed substantially greater than the rotational speed of the rear wheel during the operation of the toy vehicle.

12. The toy vehicle of claim 11 wherein the weighted flywheel of the rear wheel includes a clutch bell, the clutch assembly includes a clutch disk with at least one clutch pad for engaging the clutch bell upon rotation of the clutch disk to impart rotational movement to the flywheel, the toy vehicle further comprises:

a gear assembly housed within the rear wheel and operatively connected to the propulsion drive, the gear assembly engaging the clutch disk to impart rotational motion thereto.

13. The toy vehicle of claim 11 wherein the steering system further comprises:

a four-bar linkage connecting the front wheel to the front end to pivot the front wheel about a castering arc, the four-bar linkage being configured such that the castering arc is projected in front of the four-bar linkage.

14. The toy vehicle of claim 13 wherein the four-bar linkage further comprises:

a front end frame supported by the front end of the chassis;

upper and lower fork couplers;

a pair of spaced members extending from the front end frame to the upper and lower fork couplers, the members having first ends pivotally connected to the front end frame and second ends pivotally connected to the upper and lower fork couplers, the first ends of the members being connected at spaced positions located farther from the longitudinal axis than the respective connection points of the second ends of the members.

15. The toy vehicle of claim 11 wherein the propulsion drive drivingly rotates the rear wheel via a plurality of intermeshing gears.

16. The toy vehicle of claim 11 wherein the propulsion drive drivingly rotates the rear wheel via a drive chain.

17. A wheel-supported toy vehicle comprising:

a chassis having front and rear ends aligned along a longitudinal axis;

front and rear wheels operatively connected to and providing support for the respective front and rear ends, the front wheel having a front wheel fork coupler;

a propulsion drive supported by the chassis and drivingly coupled to the rear wheel;

a four-bar linkage connecting the front wheel frame to the front end to enable pivotal movement of the front wheel about a castering arc, the four-bar linkage being configured such that the castering arc is projected in front of the four-bar linkage;

a link having first and second ends, the first end of the link pivotally connected to the front end of the chassis at a pivot point and the second end of the link pivotally connected to the front wheel fork coupler;

a steering servo supported on the chassis and having a steering rod, the servo adapted for enabling pivotal movement of the steering rod for generating steering outputs; and at least one spring having first and second ends, the first end being connected to the steering rod at a connection point and the second end being connected to the link for transmitting the steering outputs from the servo to the link so as to pivot the front wheel about the castering arc, thereby initiating a turn of the toy vehicle.

18. The toy vehicle of claim 17 wherein the pivot point of the link coincides with the connection point of the steering rod such that when the link pivots relative to the steering rod aligned with the longitudinal axis the spring does not elongate.

19. A wheel-supported toy vehicle comprising:

a chassis having front and rear ends aligned along a longitudinal axis;

front and rear wheels operatively connected to and providing support for the respective front and rear ends, the front wheel having a front wheel fork coupler;

a propulsion drive supported by the chassis and drivingly coupled to the rear wheel;

a four-bar linkage connecting the front wheel frame to the front end to enable pivotal movement of the front wheel about a castering arc, the four-bar linkage being configured such that the castering arc is projected in front of the four-bar linkage;

a link having first and second ends, the first end of the link pivotally connected to the front end of the chassis and the second end of the link pivotally connected to the front wheel fork coupler;

a steering motor supported on the chassis and adapted to generate steering outputs; and a steering clutch operatively connecting the steering motor and the first end of the link, the clutch adapted for transmitting the steering outputs to the link so as to pivot the front wheel about the castering arc, thereby initiating a turn of the toy vehicle.

20. A wheel-supported toy vehicle comprising:

a chassis having front and rear ends aligned along a longitudinal axis;

front and rear wheels operatively connected to and providing support for the respective front and rear ends; the front wheel having upper and lower fork couplers;

a propulsion drive supported by the chassis and drivingly coupled to the rear wheel;

first and second connecting members extending from the chassis to the upper and lower fork couplers, the connecting members being configured to enable pivotal movement the front wheel about a castering arc;

a steering drive supported on the chassis, the steering drive adapted to generate steering outputs; and a link having first and second ends, the link being operatively connected to the steering drive to receive the steering outputs, the first end being pivotally connected to either the upper or lower fork couplers to deliver the steering outputs so as to pivot the front wheel about the castering arc, thereby initiating a turn of the toy vehicle.

21. The toy vehicle of claim 20 wherein each connecting member has a first end pivotally connected to the front end of the chassis and a second end pivotally connected to the upper and lower fork coupler, the first ends of the connecting members being connected at spaced positions located farther from the longitudinal axis than the respective connection points of the second ends of the members end to enable pivotal movement of the front wheel about the castering arc.

22. The toy vehicle of claim 21 wherein the castering arc is projected in front of the front wheel frame.

23. A remotely controlled, wheel-supported toy vehicle comprising:

a chassis having front and rear ends aligned along longitudinal axis;

front and rear wheels operatively connected to and providing support for the respective front ends;

a steering system operatively connecting the front wheel to the front end of the chassis, the steering system adapted to generate a steering force to initiate a turn of the toy vehicle to either the left or right of the longitudinal axis;

a propulsion drive supported by the chassis and drivingly coupled to the rear wheel;

a receiver adapted to receive remotely generated steering and propulsion signals, the receiver operatively connected to the steering system such that upon receiving a steering signal the steering system generates a steering force to initiate a turn of the toy vehicle, the receiver also operatively connected to the propulsion drive such that upon receiving a propulsion signal the propulsion drive becomes operative;

a weighted flywheel housed within and operatively associated with the rear wheel; and a clutch assembly rotatably mounted within the rear wheel and operatively connected to the propulsion drive and adapted to rotate faster than the rear wheel when the propulsion drive is operative;

wherein the clutch assembly rotatingly engages the flywheel at a predetermined rotational speed to thereby rotate the flywheel at a rotational speed substantially greater than the rotational speed of the rear wheel during the operation of the toy vehicle.

* * * * *

UNITED STATES PATENT AND TRADEMARK OFFICE

CERTIFICATE OF CORRECTION

PATENT NO. : 6,095,891
DATED : August 1, 2000
INVENTOR(S) : Michael G. Hoeting and Sean T. Mullaney It is certified that error appears in the above-identified patent and that said Letters Patent is hereby corrected as shown below:

Column 12,
Line 61, "the respective front ends" should read -- the respective front and rear ends --.

Column 15,
Line 6, "the respective front ends" should read -- the respective front and rear ends --.

Signed and Sealed this

Thirtieth Day of April, 2002

*Attest:*

*Attesting Officer*

JAMES E. ROGAN
*Director of the United States Patent and Trademark Office*